US007114450B1

(12) United States Patent
Chang

(10) Patent No.: US 7,114,450 B1
(45) Date of Patent: Oct. 3, 2006

(54) MAGAZINE FOR RECEIVING ELECTRIC SHOCK BULLETS

(76) Inventor: Weng-Ping Chang, No. 25, Sichang Rd., Jiadong Township, Pingtung County 931 (TW)

( * ) Notice: Subject to any disclaimer, the term of this patent is extended or adjusted under 35 U.S.C. 154(b) by 0 days.

(21) Appl. No.: 11/263,647

(22) Filed: Oct. 31, 2005

(51) Int. Cl.
*F41C 9/00* (2006.01)

(52) U.S. Cl. ..... 102/502; 361/232; 89/28.05

(58) Field of Classification Search ..... 102/502; 361/232; 89/28.05
See application file for complete search history.

(56) References Cited

U.S. PATENT DOCUMENTS 5,473,501 A * 12/1995 Claypool ..... 361/232
5,698,815 A * 12/1997 Ragner ..... 102/502
6,862,994 B1 * 3/2005 Chang ..... 102/502
2005/0024807 A1 * 2/2005 Cerovic et al. ..... 361/232

* cited by examiner

*Primary Examiner*—Michelle Clement
*Assistant Examiner*—Benjamin P. Lee
(74) *Attorney, Agent, or Firm*—Alan D. Kamrath; Nikolai & Mersereau, P.A.

(57) ABSTRACT

An electric shock bullet launching device includes a gun body and a magazine for receiving electric shock bullets. The magazine includes a power supply device and a charging device which charges the bullets. The magazine includes a hole in the underside thereof and is slidably connected to the body of the launching device so that the bullets are fed into a slot in a top of the body via the hole.

8 Claims, 11 Drawing Sheets

MAGAZINE FOR RECEIVING ELECTRIC SHOCK BULLETS

FIELD OF THE INVENTION

The present invention relates to a magazine for receiving electric shock bullets and more particularly to a magazine that can be cooperated with different types of electric shock bullet launching devices.

BACKGROUND OF THE INVENTION

A conventional electric shock bullet launching device 40 is shown in FIG. 9 and generally includes two electric shock bullets 42 which are connected with two wires 410, 420 and the two wires 410, 420 are connected to the launching device so as to provide electric power to the bullets 41, 42 to shock the object when the two bullets 41, 42 are both in contact with the object. However, the wires 410, 420 have limited length so that the range that the bullets 41, 42 is short. Besides, the object that the bullets 41, 42 hit may struggle to pull and break the wires 410, 420. Once the wires 410, 420 are broken, no electric power is send to the bullets 41, 42.

FIGS. 11 and 12 show another electric shock bullet launching device 60 which includes a barrel and a handle 61 in which a magazine 62 is inserted. A plurality of bullets 50 are received in the magazine 62 and fed into a chamber 610 in the barrel. Each bullet 50 includes a case 51 and a capacitor 52 is received in the case 51. Two pole needles 53, 54 extend through the front end of the case 51 and are connected to the capacitor 52. A polygonal conductive part 55 is connected to a rear end of the case 51 and a positive plate 550 and a negative plate 551 are connected to an outside of the conductive part 55. A firing device 63 and a charging device 64 are connected to a rear end of the barrel and a power supply 640 is connected tot eh charging device 64. The charging device 64 includes a positive wire 6410 connected with a positive pad 641 and a negative wire 6420 connected with a negative pad 642. The positive and negative pads 641, 642 are respectively located in the launching device 60 such that the positive plate 550 and the negative plate 551 of the bullet 50 located at the first one of the bullets 50 in the handle 61 are in contact with the positive pad 641 and the pad 642 so as to charge the bullet 50. When pulling the trigger of the launching device 60, the bullet 50 ejects out from the launching device 60 without limitation of wires or the like as described in the launching device in FIG. 9. However, the launching device 60 has to be equipped with the firing device 63 and the charging device 64, or the bullets cannot be launched.

The present invention intends to provide an electric shock bullet launching device wherein the magazine includes charging device for charging the bullets in the magazine so that the magazine can be used with different types of launching devices.

SUMMARY OF THE INVENTION

The present invention relates to an electric shock bullet launching device that comprises a body having a firing device connected to the body and a magazine is slidably connected to a top of the body. The magazine has a power supply device and a charging device received therein. The power supply device is electrically connected to the charging device. Two pole pads are located beside a hole defined in an underside of the magazine and the charging device are electrically connected to the two pole pads so as to charge electric shock bullets in the magazine. The bullets are fed into a chamber in the body via the hole defined in the underside of the magazine and a slot defined in a top of the body. Each bullet has a capacitor received therein and two pole needles which are in contact with the two pole pads. The bullets are fired by the firing device and eject from the front opening of the body.

The primary object of the present invention is to provide a electric shock bullet launching device wherein the magazine is slidably connected to a top of the body of the launching device and includes a power supply device and a charging device for charging bullets in the magazine.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
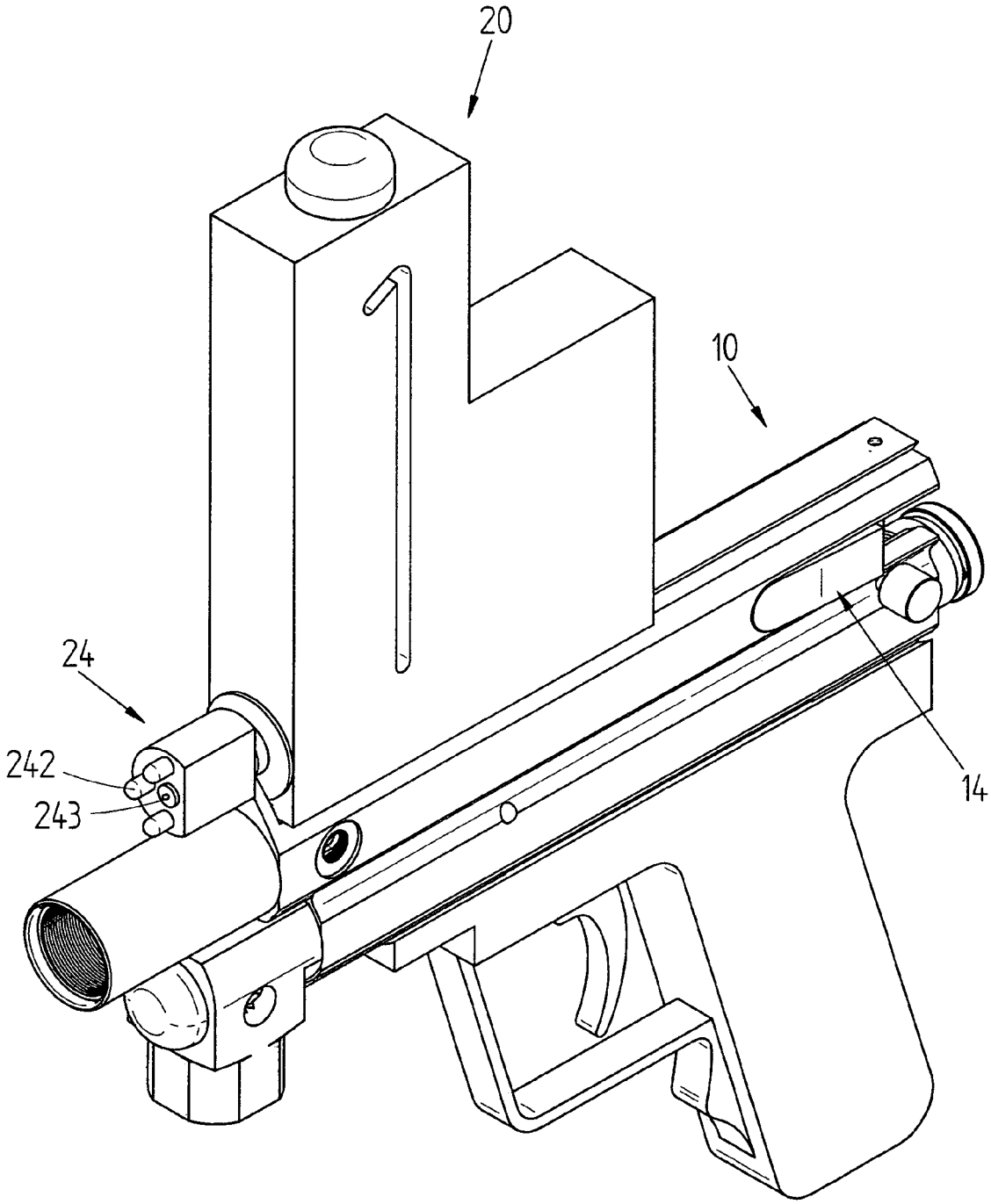
FIG. 1 is a perspective view to show the electric shock bullet launching device of the present invention.
Figure 2:
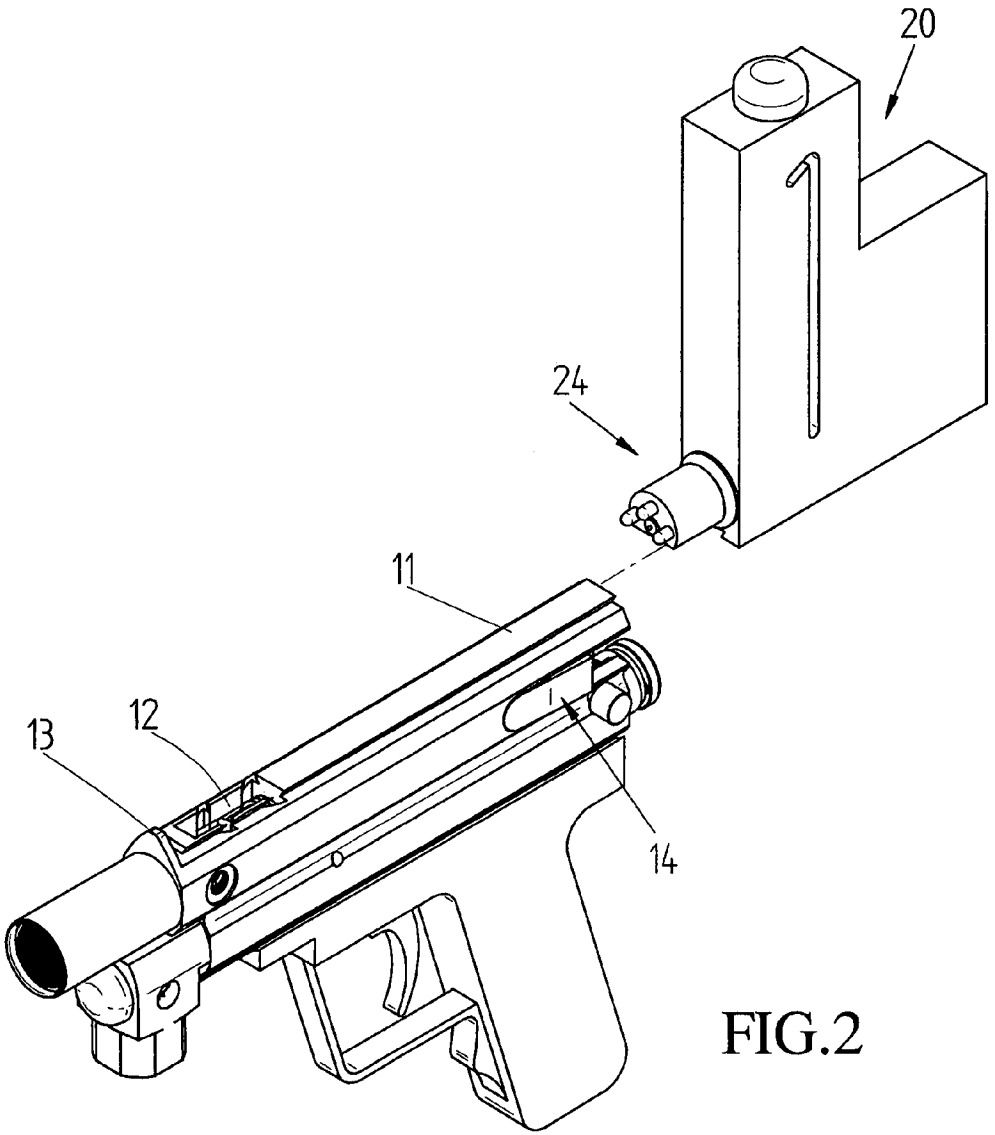
FIG. 2 is an exploded view to show the magazine and the body of the launching device of the present invention.
Figure 3:
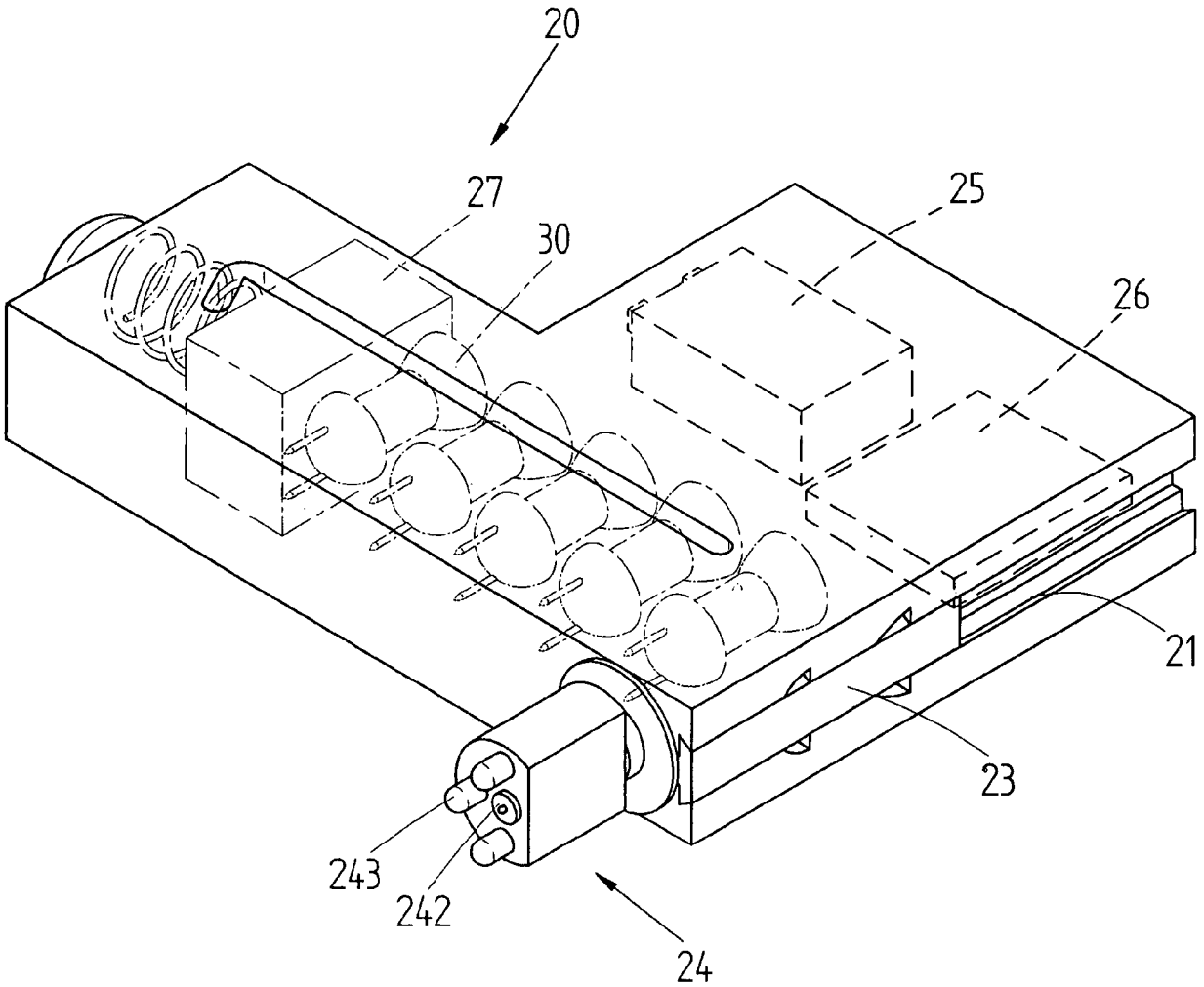
FIG. 3 shows the magazine of the present invention.
Figure 4:
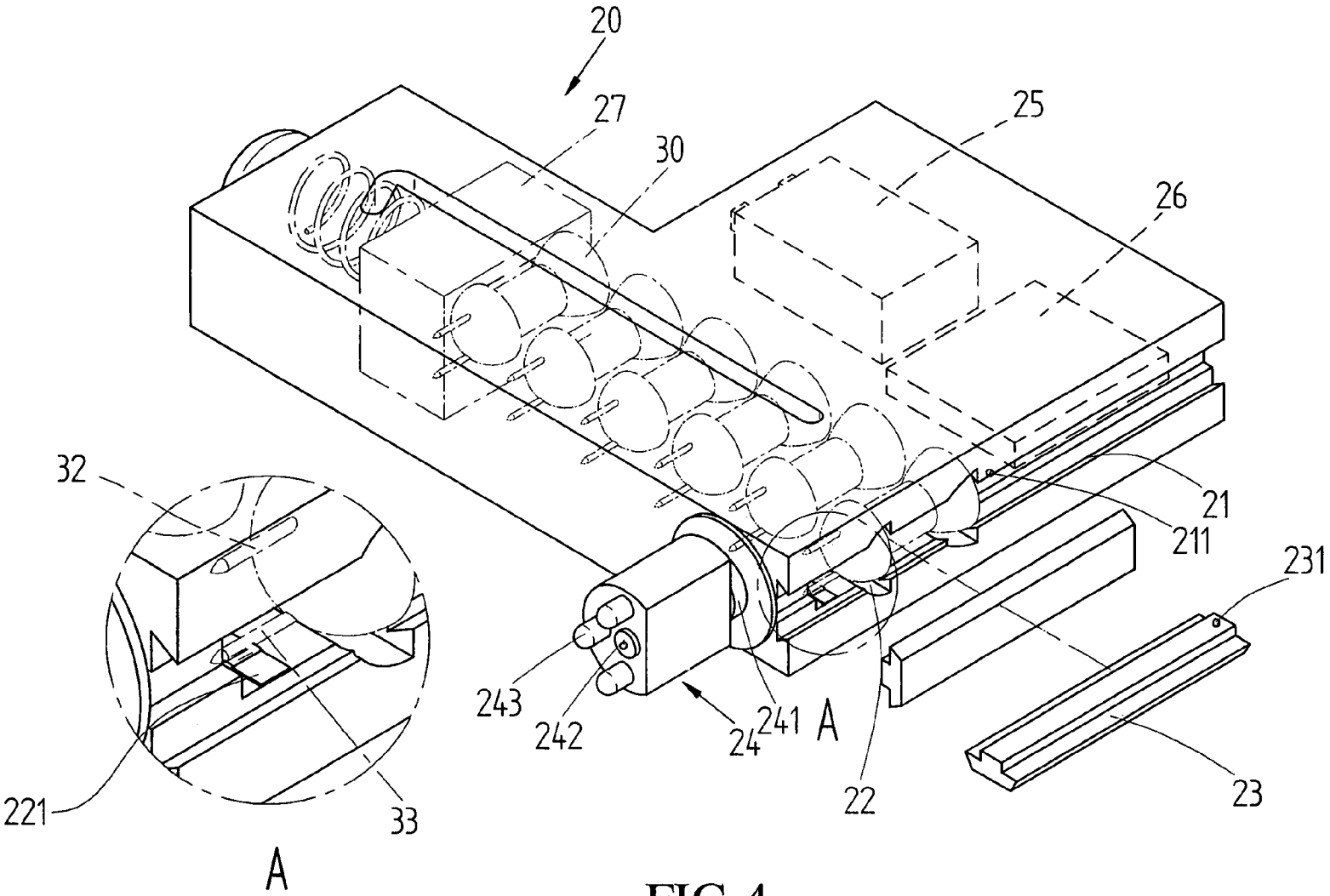
FIG. 4 shows the cover and the magazine of the present invention.

Referring to FIGS. 1 to 4, the electric shock bullet launching device of the present invention comprises a body 10 which includes a handle and a barrel, wherein a slot 12 is defined through a top of the barrel and the slot 12 communicates with a chamber in the barrel. The chamber communicates with a front opening of the barrel. A firing device 14 is connected to a rear end of the barrel so that when the user pulls the trigger, bullets which will be described hereafter, eject out from the front opening. A rail 11 is located on the top of the body 10.

A magazine 20 has a groove 21 defined in an underside thereof so that the magazine 20 is slidbaly connected to the body 10 by engaging the rail 11 with the groove 21. The magazine 20 has a hole 22 defined in the underside thereof so that the electric shock bullets 30 are inserted into the magazine 20 via the hole 22. A pushing device 27 is located in the magazine 20 so as to push the bullets 30 toward the hole 22 and the bullets 30 can be fed into the barrel through the slot 12. A cover 23 is slidably engaged with the groove 21 of the magazine 20 and removably covers the hole 22. A boss 231 extends from the cover 23 and is removably engaged with a notch 211 defined in an inside of the groove 21, so that the bullets 30 do not fall from the hole 22 when the magazine 20 is not connected to the barrel. The magazine 20 has a power supply device 25 and a charging device 26 received therein. The power supply device 25 is electrically connected to the charging device 26 and two pole pads 221 are located beside the hole 22 of the magazine 20. The charging device 26 is electrically connected to the two pole pads 221.

Figure 7:
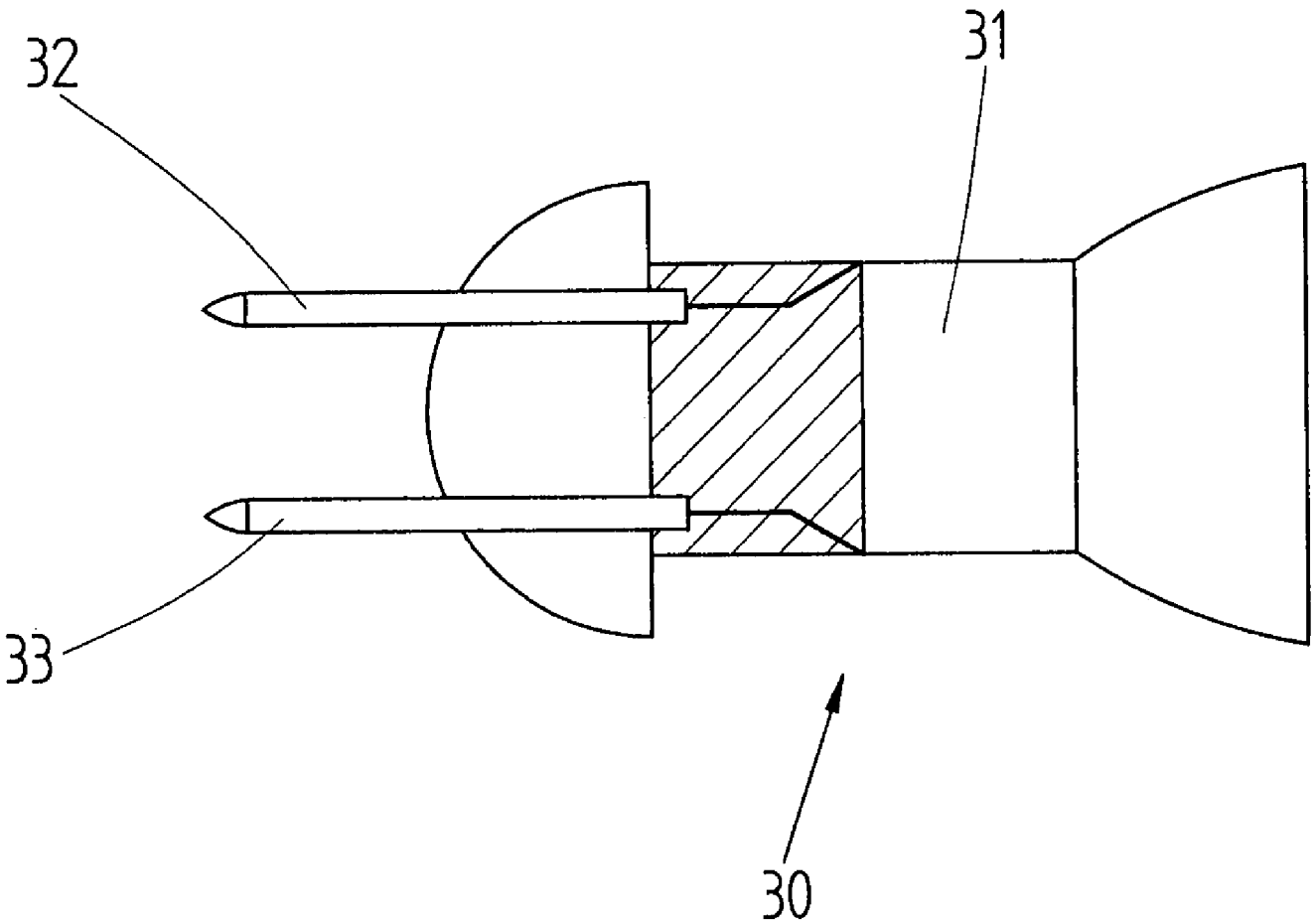
FIG. 7 is a cross sectional view to show the electric shock bullet of the present invention.
Figure 8:
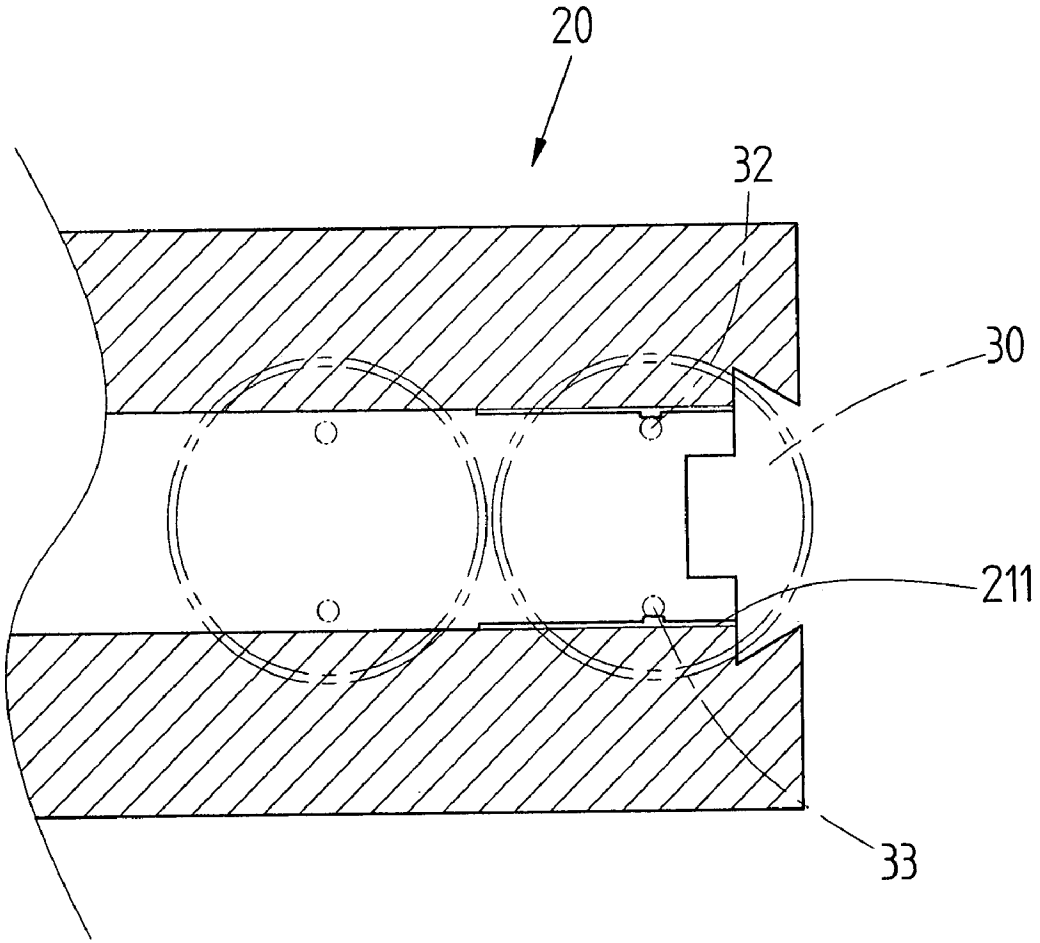
FIG. 8 shows that the bullet is charged by the charging device of the present invention.
Figure 9:
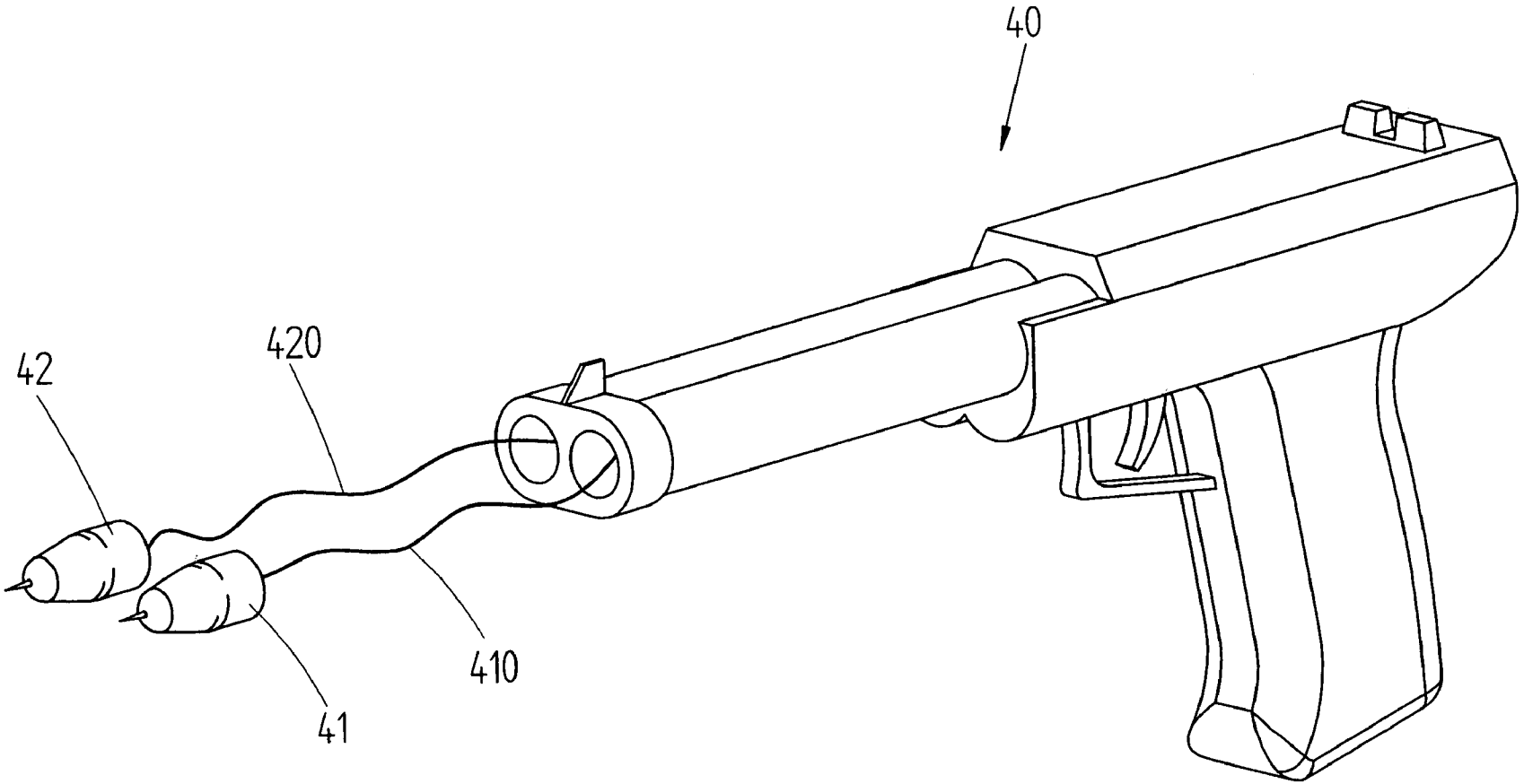
FIG.9 PRIOR ART
FIG. 9 is a perspective view to show a conventional electric shock bullet launching device.
Figure 10:
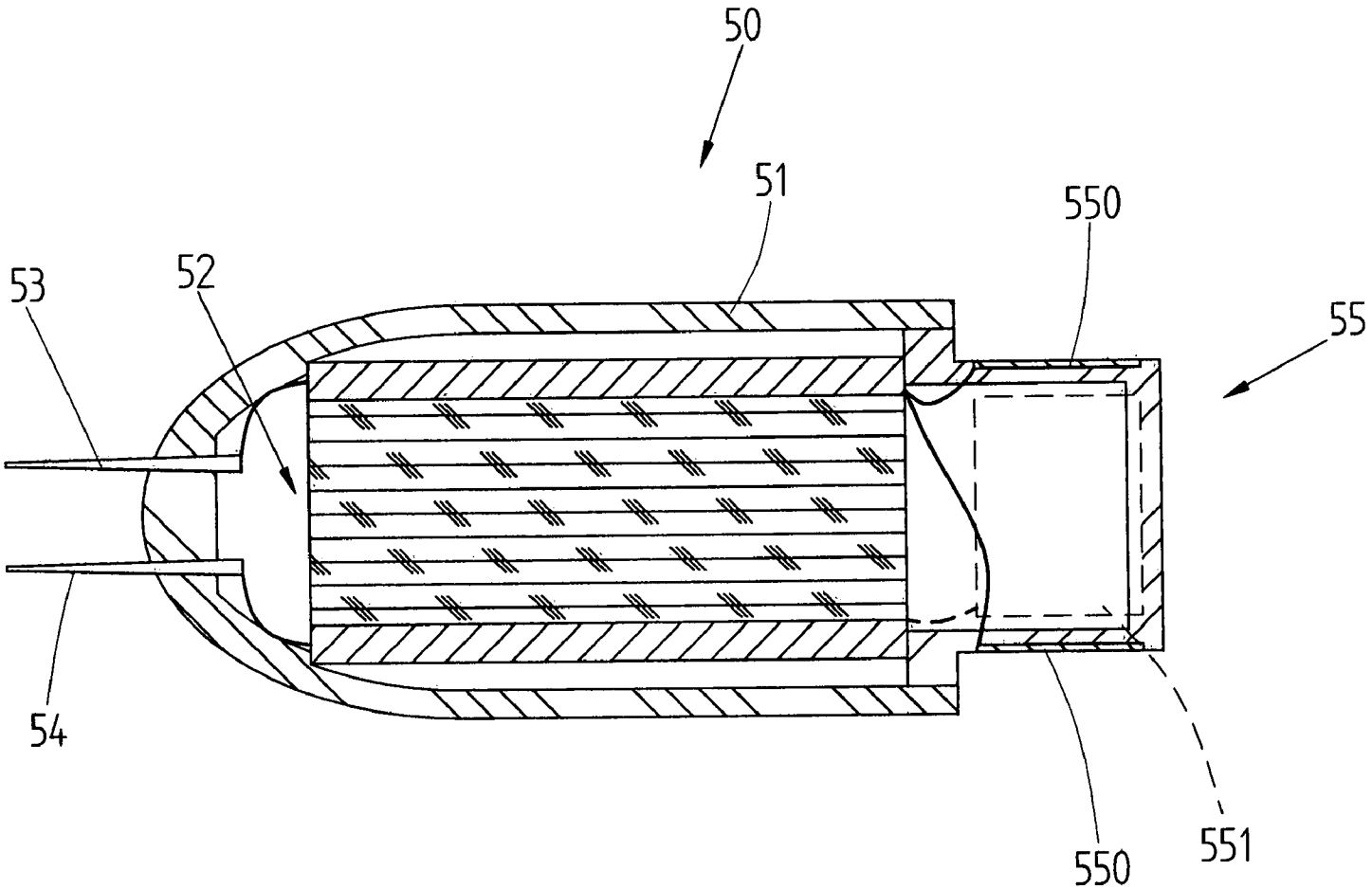
FIG.10 PRIOR ART
FIG. 10 is a cross sectional view of the conventional electric shock bullet.
Figure 11:
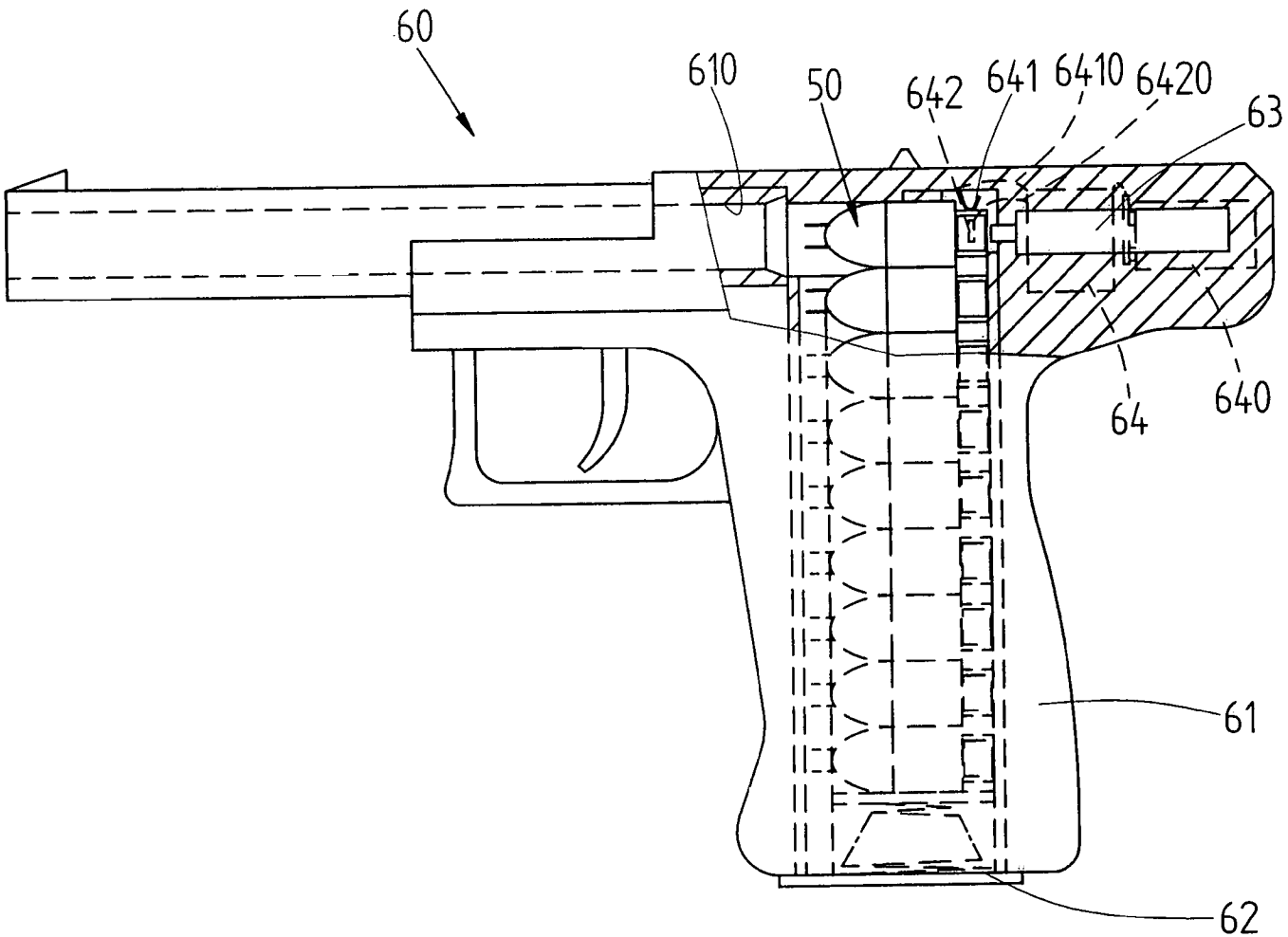
FIG.11 PRIOR ART
FIG. 11 is a cross sectional view to show another conventional electric shock bullet launching device.

Further referring to FIGS. 7 and 8, each electric shock bullets 30 received in the magazine 20 has a capacitor 31 received therein and two pole needles 32 33 extend from a front end of the bullet 30. The two pole pads 221 contact the two pole needles 32, 33 of the bullet 30 located at the hole 22 and charge the bullet 30. When the trigger is pulled, the bullets 30 are fired by the firing device 14 one by one from the front opening of the barrel.

Figure 5:
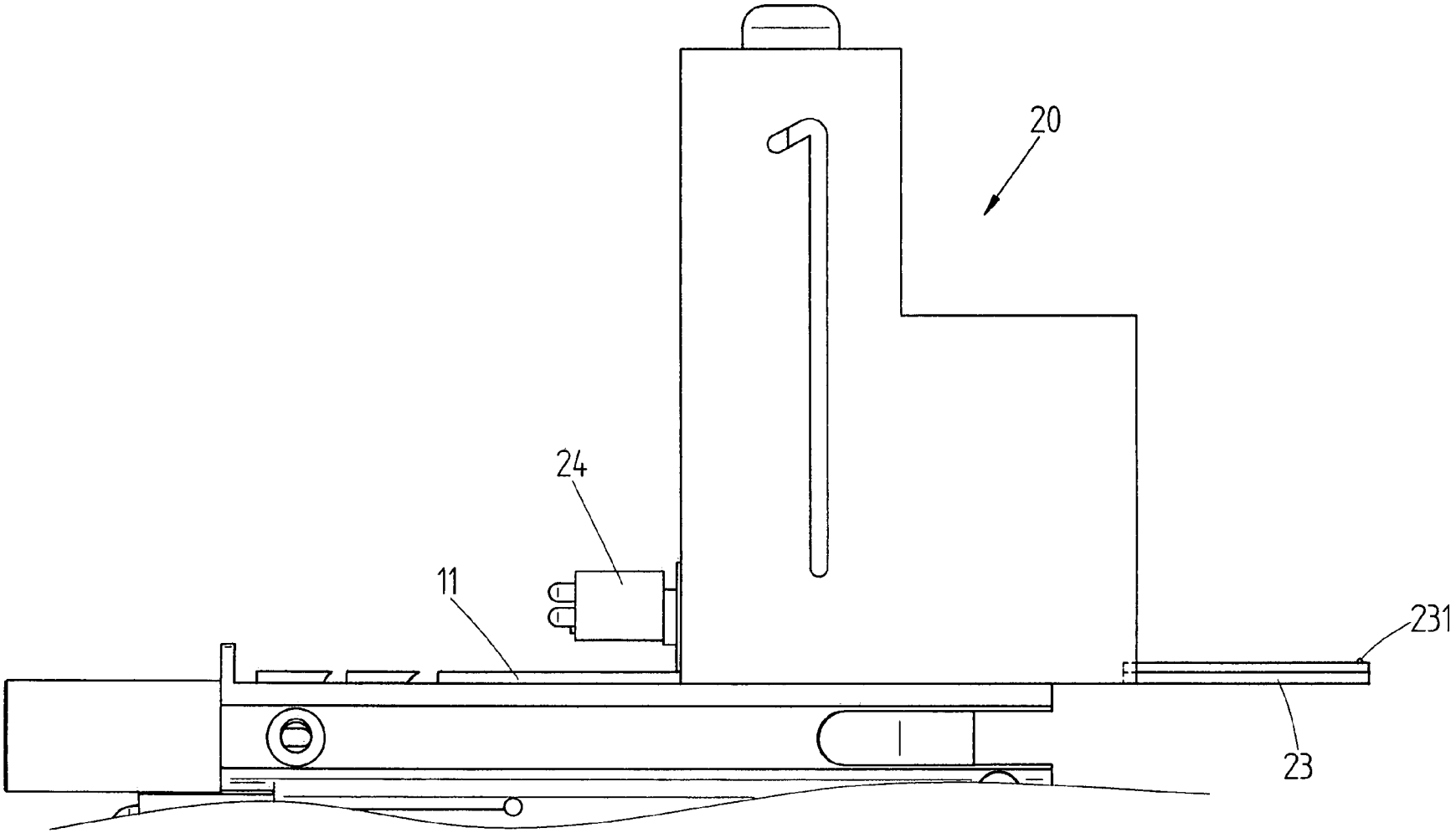
FIG. 5 is a side view to show that the magazine is slid onto the body of the launching device of the present invention.
Figure 6:
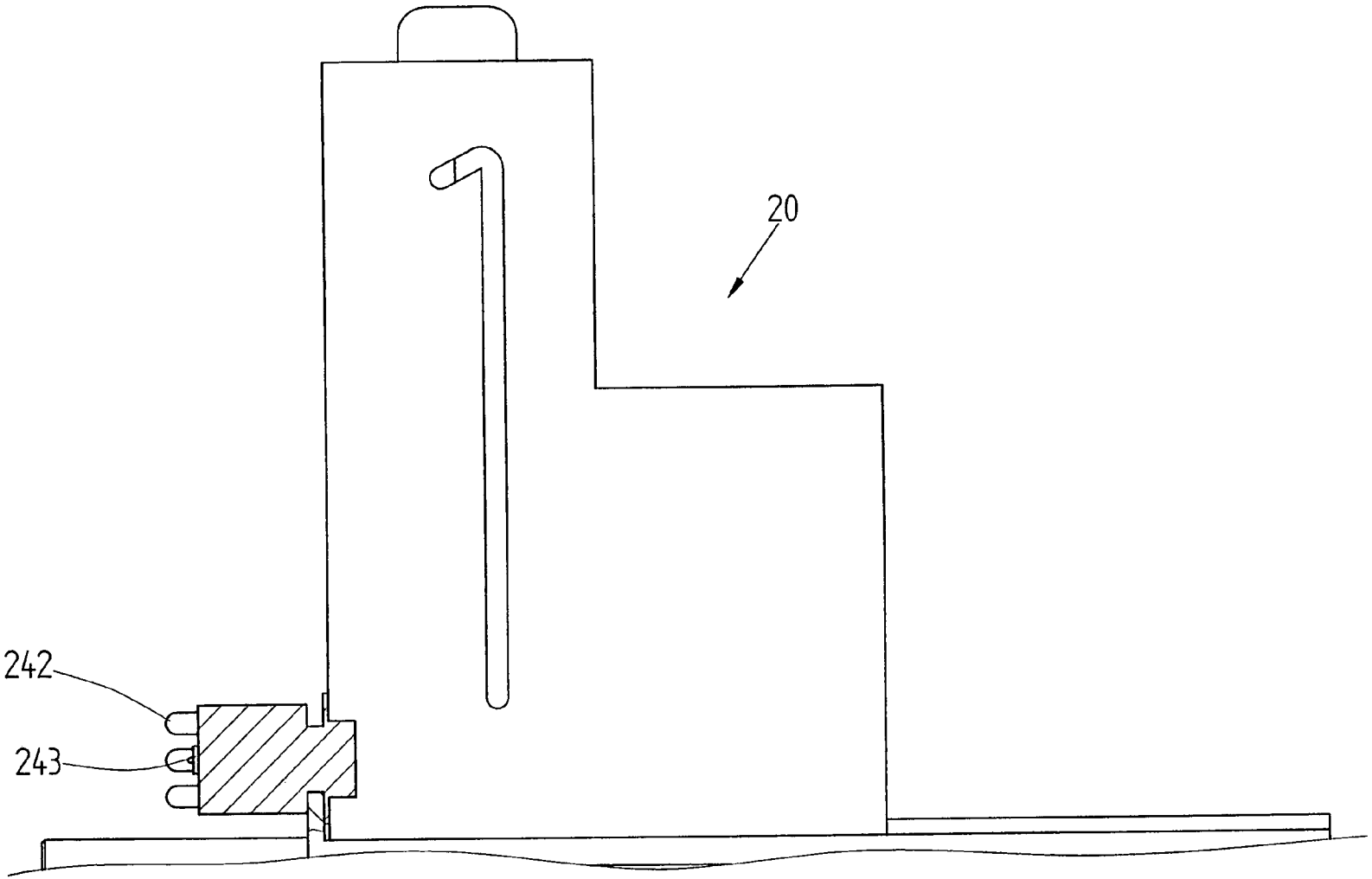
FIG. 6 shows that the aiming device is engaged with the plate on the body of the launching device of the present invention.

Further referring to FIGS. 5 and 6, an aiming device 24 is connected to a front end of the magazine 20 and a neck 241 is connected between the aiming device 24 and the front end of the magazine 20. The body 10 has a plate 13 extends from the top of the body 10 and the aiming device 24 includes a flat surface and a distance from the underside of the magazine 20 to the flat surface is larger than a height of the plate 13 when the flat surface faces the top of the body 10. In other words, when the magazine 20 is slidably connected to the body 10, the aiming device 24 is moved over the plate 13 with the flat surface faces toward the body 10, and the aiming device 24 is then rotated an angle to let the plate 13 be engaged with the annular recess defined by the neck 241 so that the magazine 20 is secured. The cover 23 is removed from the magazine 20 when the rail 11 engaged with the groove 21 of the magazine 20. The aiming device 24 further has an infrared beam generating device 242 and lighting bulbs 243 connected to a front end thereof so as to provide aiming function and illuminating features.

The magazine 20 has its own power supply device 25 and charging device 26 so that the magazine 20 can be used for different types of electric shock bullet launching devices.

While we have shown and described the embodiment in accordance with the present invention, it should be clear to those skilled in the art that further embodiments may be made without departing from the scope of the present invention.

What is claimed is:

1. An electric shock bullet launching device comprising:

a body having a slot defined through a top of the body and the slot communicating with a chamber in the body, the chamber communicating a front opening of the body, a firing device connected to the body;

a magazine slidably connected to the top of the body and having a power supply device and a charging device received therein, the power supply device electrically connected to the charging device, the magazine having a hole defined in an underside thereof and two pole pads located beside the hole of the magazine, the charging device electrically connected to the two pole pads, and a plurality of electric shock bullets received in the magazine via the hole and each bullet having a capacitor received therein and two pole needles extending from a front end of the bullet, the two pole pads contacting the two pole needles of the bullet located at the hole, the bullets being fired by the firing device and ejecting from the front opening of the body.

2. The device as claimed in claim 1, wherein a rail is located on the top of the body and the magazine has a groove defined in the underside thereof, the magazine is slidably connected to the body by engaging the rail with the groove.

3. The device as claimed in claim 1, wherein the magazine has a pushing device which pushes the bullets toward the hole.

4. The device as claimed in claim 2, wherein a cover is slidably engaged with the groove of the magazine and removably covers the hole, a boss extends from the cover and is removably engaged with a notch defined in an inside of the groove.

5. The device as claimed in claim 1, wherein an aiming device is connected to a front end of the magazine and a neck is connected between the aiming device and the front end of the magazine, the body has a plate that extends from the top of the body and the plate is engaged with an annular recess defined by the neck.

6. The device as claimed in claim 5, wherein the aiming device has an infrared beam generating device connected to a front end thereof.

7. The device as claimed in claim 5, wherein a plurality of lighting bulbs are connected to a front end of the aiming device.

8. The device as claimed in claim 5, wherein the aiming device includes a flat surface and a distance from the underside of the magazine to the flat surface is larger than a height of the plate when the flat surface faces the top of the body.

* * * * *